US005524308A

United States Patent [19]

Hwang et al.

[11] Patent Number: 5,524,308

[45] Date of Patent: Jun. 11, 1996

[54] SLEEPING MAT AND SEATING ARRANGEMENT

[76] Inventors: Phillip Hwang; Lisa Hwang, both of c/o Goodway Corporation, P.O. Box 58994, Taipei, Taiwan

[21] Appl. No.: 374,413

[22] Filed: Jan. 19, 1995

Related U.S. Application Data

[62] Division of Ser. No. 106,207, Aug. 13, 1993, Pat. No. 5,384,923.

[51] Int. Cl.[6] ..... A47G 9/00

[52] U.S. Cl. ..... 5/644; 5/645; 5/490

[58] Field of Search ..... 5/636, 639, 643, 5/644, 645, 485, 490, 419; 207/5

[56] References Cited

U.S. PATENT DOCUMENTS

| | | | |
|---|---|---|---|
| 305,428 | 9/1884 | Covert | 5/644 X |
| 1,935,685 | 11/1933 | White | 5/636 X |
| 2,896,227 | 7/1959 | Reed | 5/644 |
| 3,974,531 | 8/1976 | Van Pelt | 5/490 |
| 4,165,125 | 8/1979 | Owen | 5/490 X |
| 4,501,034 | 2/1985 | Greenawalt | 5/636 X |
| 4,768,245 | 9/1988 | Dutton | 5/490 X |
| 4,780,921 | 11/1988 | Lahn et al. | 5/490 X |
| 4,815,154 | 5/1989 | Grimes | 5/644 X |
| 5,317,772 | 6/1994 | Perl et al. | 5/636 X |

*Primary Examiner*—Michael F. Trettel

[57] ABSTRACT

An improved camping sleeping mat and/or chair arrangement having improved lateral edge stiffening rod retention pockets and having coupling members for coupling various portions together in various configurations. A separate inflatable pillow may be detachably mounted on the camping sleeping mat and/or chair arrangement.

9 Claims, 6 Drawing Sheets

FIG. 3
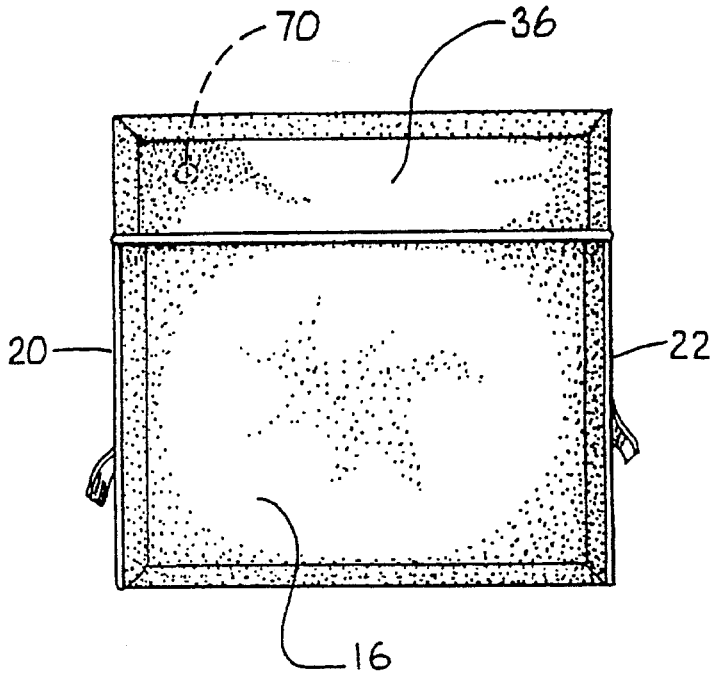
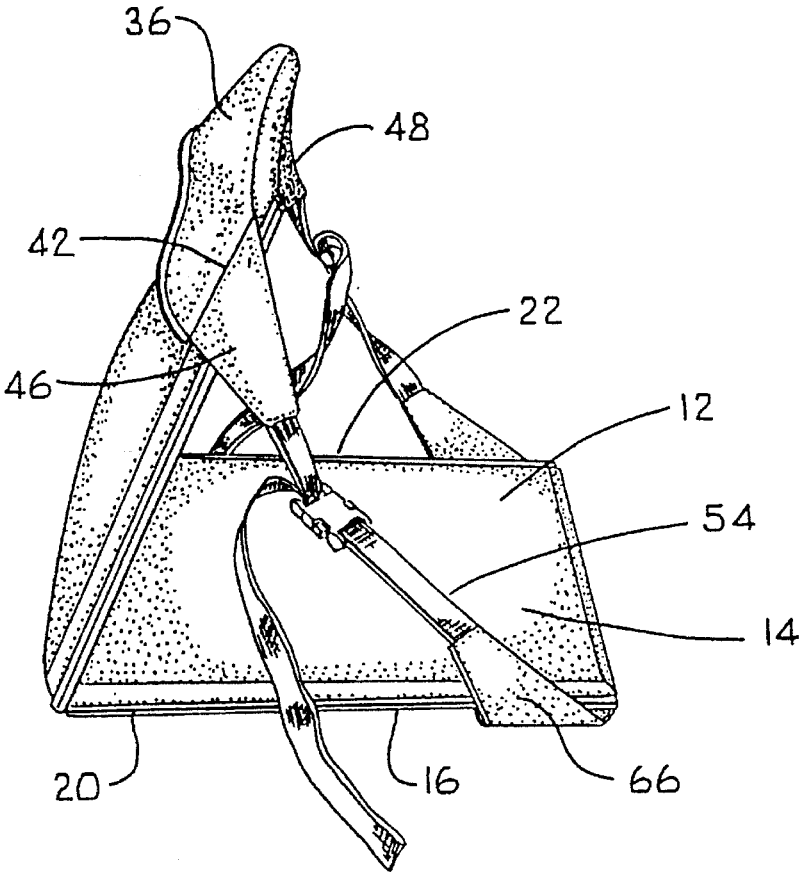
FIG. 4

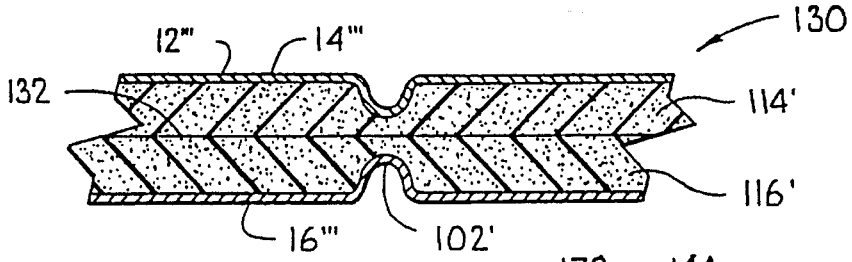
FIG. 9
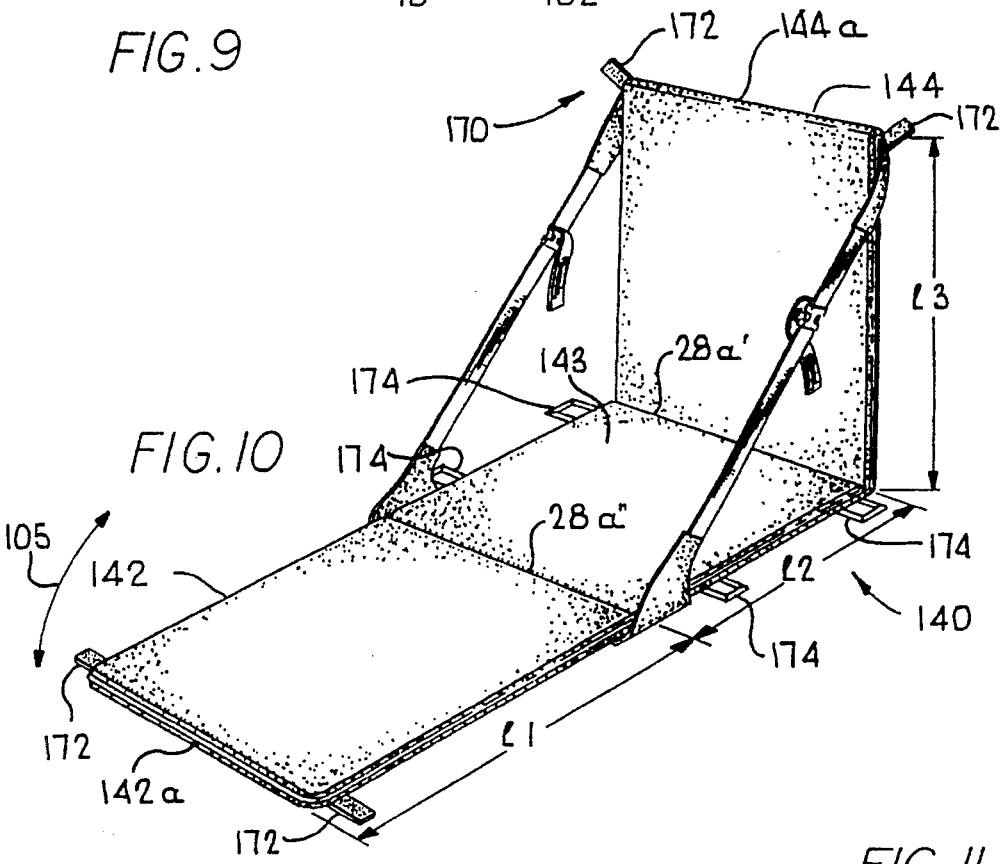
FIG. 10
FIG. 11
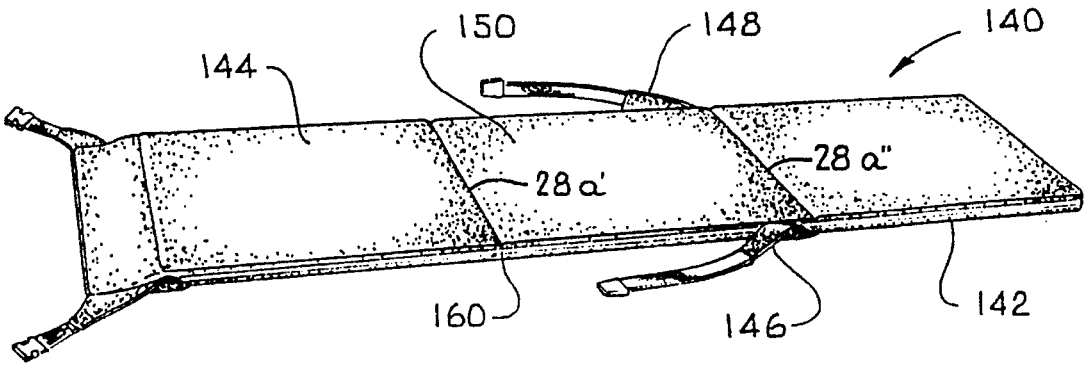

SLEEPING MAT AND SEATING ARRANGEMENT

This application is a division of patent application Ser. No. 08/106,207, filed Aug. 13, 1993, now U.S. Pat. No. 5,384,923.

REFERENCE TO RELATED APPLICATION

This invention is an improvement to our invention described and claimed in U.S. Pat. No. Des. 329,148, issued Sep. 8, 1992, and U.S. Pat. No. 5,190,350, issued Mar. 2, 1993, and the teaching and technology of each is incorporated herein by reference.

INVENTORS OF THE PRESENT INVENTION

The inventors of the present invention are Phillip Hwang and Lisa Hwang. Phillip Hwang and Lisa Hwang are citizens of the Republic of China with a residential address of Room 4-5 Buckingham Mansion, 6, Lane 269, Nanking East Rd., Sec. 3, Taipei, Taiwan, Republic of China. The inventors mailing address is c/o Goodway Corporation, Post Office Box 58994, Taipei, Taiwan Republic of China.

BACKGROUND OF THE INVENTION

1. Field of the Invention

This invention relates to the sleeping/seating art and, more particularly to an improved portable sleeping mat/seating arrangement particularly useful in various outdoor activities ranging from backpacking, camping, mountain climbing and the like, to comfortable seating at stadiums or other locations where more comfort in seating is desired than is provided.

2. Description of the Prior Art

Various types of portable sleeping mats/seating arrangements have heretofore been made available. One such application is in the mountain climbing, backpacking, and generally outdoor activity fields. As such, such portable sleeping mats/seating arrangements are preferably comparatively lightweight and are flexible so that they may be readily folded or rolled into a comparatively compact arrangement. One such portable seating arrangement heretofore available had a flexible cover having a lower layer and an upper layer. The lower layer was continuous from one end to the other. The upper portion was divided along a central line extending between the peripheral edges and a flexible plastic foam pad was removably insertable through the slit in the upper layer. Such a seating arrangement folded along the slit. Large pockets were provided along the lateral peripheral edges of such a prior art seating arrangement and padded rigid members were insertable into the four pockets extending along the lateral edges from openings aligned with the slit in the upper layer. The pad was not bonded to the cover. At the top and bottom of the seating arrangement above described, flaps extending outwardly from the above-mentioned pockets were provided and straps were coupled to these flaps for detachable coupling together so that the back portion of the seating arrangement could move along a fold line towards and away from the seat portion and be restrained in any desired angular position by the strap means, the fold occurring along the above-mentioned slit in the body.

Such portable seating arrangement has not proven to be completely satisfactory. In addition to relative movement between the pad and the cover surrounding the pad, the cover was not air tight and, therefore, could not be inflated and deflated to provide either a comparatively small volume when deflated or greater resistance to compression when inflated. Additionally, the bulk of the padded rigid members extending on the pockets on the lateral edges of the body prevented convenient rolling of the entire unit into a comparative small configuration. Further, there was no reinforcing along the remote ends extending between the lateral edges and, therefore, there was considerable flexing of the back portion and the seat portion when in use because of the forces imposed thereon. Such bending or flexing detracted from the comfort of the unit when so utilized as a seat.

In other prior art arrangements, mats or pads utilized for backpackers, campers, or the like for sleeping have incorporated an open-cell foam inside a body member having an upper layer and a lower layer and the closed-cell foam bonded throughout its extent to the upper layer and lower layer of the body member. Such sleeping pads have also been provided with an air valve to allow air to selectively enter and leave the cavity containing the open-cell foam pad. However, such pads have not been provided with a fold line to allow folding of the pad into a configuration having a back and a seat.

In other applications as described in U.S. Pat. No. 5,190,350, the length of a seating arrangement is made sufficient to allow the unit when in a flat configuration, to serve as a sleeping mat. Such a unit thus serves the functions of both a sleeping mat and a seat. By providing properly located fold lines, a portion of the unit could be folded substantially flat to overlie another portion and thus provide a double thickness for seating comfort.

In both a seating configuration and a sleeping configuration, it is often desired to have a pillow upon which the head may rest in either or both the sleeping and seating configuration.

Further, while the invention in U.S. Pat. No. 5,190,350 utilizes a flap portion for distributing forces along, for example, the top of the back portion, for the unit in a seating configuration, the present invention may be utilized in embodiments wherein such flap portion is eliminated.

Many of the prior art sleeping mats/seating arrangements have often been awkward or inconvenient to move when not in the fully rolled up and stored configuration. Therefore, there has long been a need for such a sleeping mat and/or seating arrangement to have provisions for compactly refraining the unit without requiring that the unit be placed in its full roll up and stored configuration.

Therefore, there has long been a need for a portable, flexible lightweight sleeping mat and/or seating arrangement having an air-tight cavity for retaining a pad and which cavity may be inflated and deflated as desired and for which a pillow may be provided.

Additionally, it has long been desired to provide a sleeping mat and/or seating arrangement of the type above described in which an improved structure along the lateral edges for removable retention of a stiffening rod may be provided.

Further, there has long been a need to provide an improved sleeping mat and/or seating arrangement which may be detachably but securely configured in a folded configuration for the convenient moving and handling thereof.

SUMMARY OF THE INVENTION

Accordingly, it is an objective of the present invention to provide an improved portable sleeping mat and/or seating arrangement.

It is another of the present invention to provide an improved portable seating arrangement in which a body means has an air-tight pad receiving cavity in which a pad is received and the cavity may be inflated and deflated with air to increase and decrease the resistance to forces imposed thereon.

It is yet another object of the present invention to provide an improved seating arrangement in which comparatively small, rigid removable reinforcing members are provided adjacent the lateral edges in a more secure configuration to provide enhanced stability of the unit in use.

The above and other objects of the present invention are achieved, according to a preferred embodiment thereof, by providing a flexible air-tight body means having an upper layer, a lower layer, and spaced apart remote ends and spaced apart lateral edges extending between the remote ends. The air-tight body means defines an air-tight pad means receiving cavity between the upper and lower layers. The body means is moveable from a flat position wherein the entire seating arrangement is substantially planar to a seating position wherein a back portion extends at a predetermined angle from the seat portion and is restrained at such predetermined angle. Such angle may be, for example, on the order of 90°, more than 90°, or less than 90°, depending upon the particular angle providing the most comfort for the user thereof.

In order to provide the resistance to flexing along the remote ends of the seating arrangement, in this embodiment of the present invention, a pair of flexible flap means are coupled to the body means, one at the first remote end and the other at the second remote end and each flap means extends between the lateral edges. The flap means has a preselected distance between an inner end that is coupled to the body means and an outer end so that the flap means, when the seating arrangement is in the seating position, may overly regions adjacent the remote ends of the body means. The flap means has tab portions extending outwardly from the flap means and flexible strap means are coupled to the tab portions for detachable coupling together to restrain the seating arrangement in the desired seating position.

Means are provided to define a fold line along which the seating arrangement folds to move the back portion and seat portion relative to each other between the flat position to the seating position. In one preferred embodiment of the present invention the fold line is provided by dividing the pad means which is inserted in the pad means receiving cavity of the body means into two portions: a back portion and a seat portion. A space is left between the back portion and seat portion of the pad means, and the space extends between the lateral edges along the fold line and this region free of the pad means defines the fold line. The two layers of the body means which define the pad means receiving cavity are not coupled to each other in this fold line region.

In another embodiment of the present invention, the fold line is provided by heating and partially collapsing the pad means along the desired fold line but not collapsing the pad means completely in order that there may be air flow continuously between the seat portion and the back portion.

In other aspects of the present invention, the length of the unit may be provided so that in the extended position the unit may serve as a sleeping mat. Further, in such units, a plurality of substantially parallel, spaced apart, fold lines, for example two, may be provided so that the unit is divided into three portions. The lateral extent of the three portions may, if desired, be different so that the portions are not of equal lateral length.

In preferred embodiments of the present invention the flap means and the tab portions are provided by extensions of the upper and lower layers of the body means which define the pad means receiving cavity, and are bonded to each other. However, it will be appreciated that, in some applications, the tab portions, without the flap portions, may be provided by attaching the tab portions directly to the edge margins of the unit.

Strap means are coupled to the tab means for detachable coupling together and such strap means provide a means for restraining the seating arrangement in the seating position. In the seating position, with the flap means overlying the remote end portions of the seat portion and back portion, the forces transmitted are distributed along the entire width between the lateral edges of the body means in the area of overlap between the flap means and the body means and, thus, the flexing or bending of the body means is minimized to provide the additional comfort desired. In those embodiments, without a flap portion, the tab means transmits the resistance directly to the body means.

A valve means of conventional design may be provided in the body means communicating with the pad means receiving cavity. The valve has an open position in which air is free to flow into and out of the pad means receiving cavity of the body means and a closed position wherein the flow of air is prevented from entering or leaving the pad means receiving cavity of the body means.

In another embodiment of the present invention, the seat portion may be extended to a length greater than the back portion so that, in the flat position, the seating arrangement may serve additionally as a sleeping mat or pad. In such an embodiment, the tabs utilized for attaching the straps adjacent to the seating portion may be intermediate the fold line and the remote end of the seat portion because of its extra length and the flap means may be eliminated from such an arrangement, if desired. Further, it will be appreciated that in other embodiments of the present invention the flap means may be eliminated from the seat portion according to the principals of the present invention regardless of the length of the seat portion if additional support is not needed along the remote end of the seat portion. Further, in other embodiments, more than one fold line may be provided in substantially parallel spaced apart relationship to allow folding of one portion over another portion for improved seating comfort by doubling the thickness of the seat.

In other aspects of the present invention, an inflatable pillow which may be detachably mounted on an end portion of the body means is provided.

Pocket means are provided along the lateral edges in which comparatively small reinforcing rods may be detachably inserted to provide rigidity to the lateral edges in both the seat portion and back portion. The pocket means are configured to provide a more secure retention of the rods.

BRIEF DESCRIPTION OF THE DRAWINGS

The above and other embodiments of the present invention may be more fully understood from the following detailed description taken together with the accompanied drawings wherein similar reference characters refer to similar elements throughout and in which:

FIG. 3 is a back-elevational view of the embodiment shown in FIG. 1 in the seating position thereof;

FIG. 4 is a side perspective view of the seating arrangement illustrated in FIG. 1;

FIG. 9 is a partial sectional view of another embodiment of the present invention;

FIG. 10 is a perspective view of another embodiment of the present invention in the seating position thereof; and FIG. 11 is a perspective view of the embodiment shown in FIG. 10 in a flat position thereof;

DESCRIPTION OF THE PREFERRED EMBODIMENTS

Figure 1:
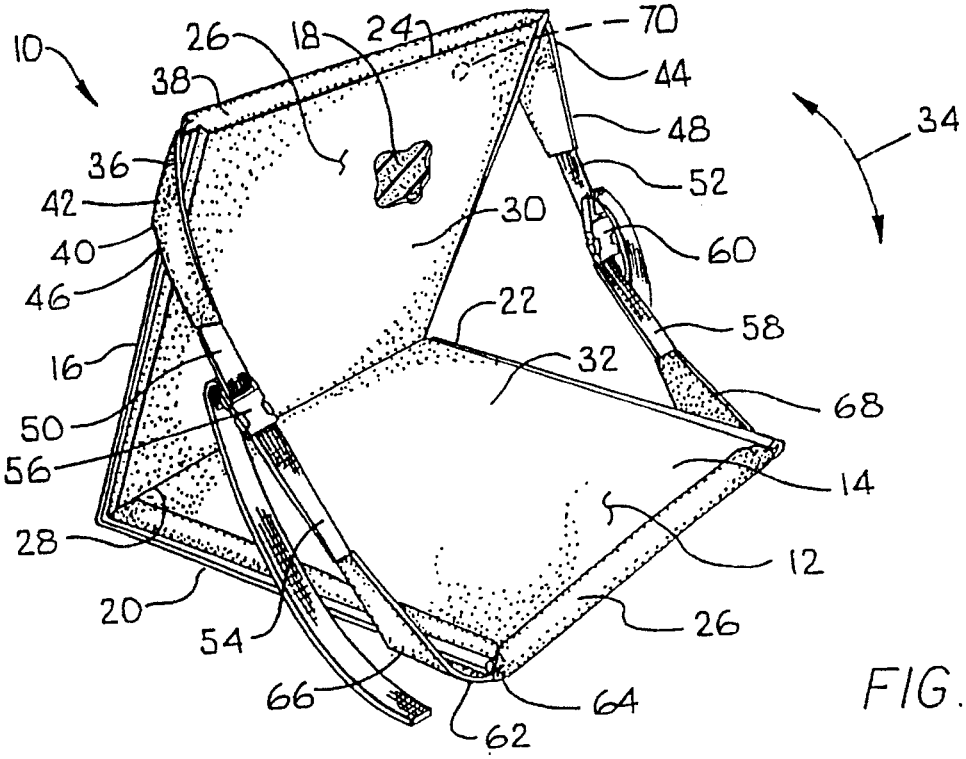
FIG. 1 is a perspective view of a preferred embodiment of the present invention in the seating position thereof.

As described in our U.S. Pat. No. 5,190,350, referring now to FIGS. 1, 2, 3, and 4 hereof, there is illustrated a preferred embodiment of the present invention generally designated 10. The embodiment 10 is generally comprised of a body means 12 having an upper layer 14 and a lower layer 16 which define a air-tight pad means receiving cavity generally designated 18 between the upper layer 14 and lower layer 16. The upper layer 14 and lower layer 16 are coupled to each other around the periphery of the pad means accepting cavity 18 and define a pair of spaced apart lateral peripheral edges generally designated 20 and 22, a first end peripheral edge 24 and a second end peripheral edge 26 spaced apart from the first end peripheral edge 24.

A pad means generally designated 26 is located in the pad means receiving cavity 18.

Means are provided for providing a fold line generally indicated at 28 extending between the lateral peripheral edges 20 and 22 and intermediate the first end peripheral edge 24 and second end peripheral edge 26. The fold line 28 divides the body means 12, as well as the pad means 26, into a back portion generally designated 30 and a seat portion generally designated 32. The back portion 30 and seat portion 32 are moveable towards and away from each other about the fold line 28 in the directions indicated by the double-ended arrow 34.

A first flexible flap means generally designated 36 extends between the pair of lateral peripheral edges 20 and 22 and has an inner edge generally designated 38 coupled to the first end peripheral edge 24 and an outer end generally designated 40 spaced a preselected distance from the inner edge 38 and first and second side edges generally designated 42 and 44 extending between the inner edge 38 and outer end 40 and adjacent the lateral edges 20 and 22 of the body member 12. The first flexible flap means is provided with a first flexible tab portion generally designated 46 and a second flexible tab portion generally designated 48. The first flexible tab portion 46 and second flexible tab portion 48 may be of unitary construction with the first flexible flap means 36 or may be separate structures secured to the first flexible flap means 36. The first flexible flap means 46 has a first strap means generally designated 50 coupled thereto and the second flexible flap means 48 has a second strap means generally designated 52 coupled thereto. The strap means 50 and 52 may be coupled by bonding, sewing, or any other desired type of adhering that may be utilized in any particular desired application.

In other aspects of the present invention, the tab portions 46 and 48 may be secured directly to the lateral edges 20 and 22, respectively, and the flap means 36 eliminated.

A third flexible strap means generally designated 54 is provided for detachable coupling by means of a buckle 56 to the first flexible strap means 50. It will be appreciated, however, that any other type of detachable coupling between the first flexible strap means 50 and second flexible strap means 54 may be provided as desired, such as hook-and-loop type of engagement or the like. Similarly, a fourth flexible strap means generally designated 58 is detachably coupled by means of a buckle 60 to the second flexible strap means 52 and, similarly, any desired type of detachable securing such as hook-and-loop can be provided for coupling the second flexible strap means 52 to the fourth flexible strap means 58. When so detachably coupled together, the strap means 50, 52, 54, and 58 provide a means for securing the back portion 30 to the seat portion 32 in the seating position of the seating arrangement 10 as illustrated in FIG. 1. The angle between the back portion 30 and seat portion 32 may be 90°, more than 90°, or less than 90°, as desired for comfort for the person utilizing the seating arrangement 10.

In the embodiment 10 illustrated in FIG. 1, attachment means are provided for coupling the third strap means 54 and fourth strap means 58 to the body means 12. In the embodiment 10, the attachment means generally designated 62 is provided by a second flexible flap means generally designated 64 coupled to the second end peripheral edge 26 in a manner similar to the first flap means 36 attachment to the first peripheral edge. Similarly, a third tab portion 66 and fourth tab portion 68 may be provided which are similar to the first tab portion 46 and second tab portion 48 as above described.

Figure 2:
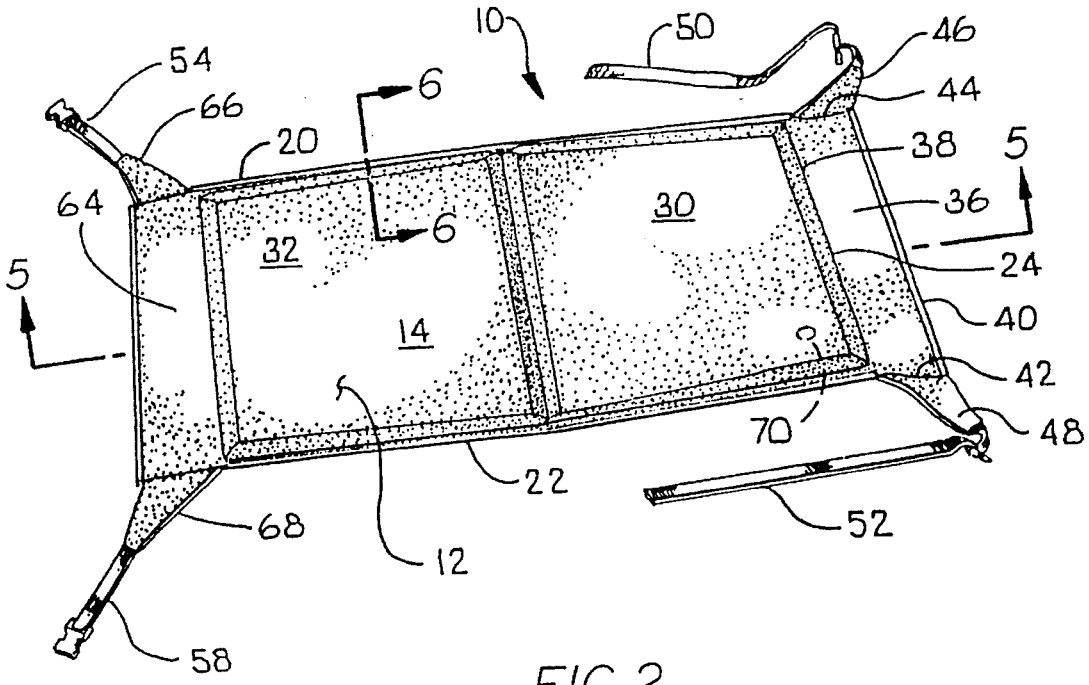
FIG. 2 is a perspective view of the embodiment illustrated in FIG. 1 in the flat position thereof.

FIG. 2 illustrates the embodiment 10 in its flat position thereof. The flat position is achieved when the first, second, third, and fourth flexible strap means 50, 52, 54, and 58, respectively, are detached.

A valve means generally indicated at 70 extends through the lower layer 16 of the body means 12 and into the pad receiving cavity 18. A valve means 70 may be of conventional design and has an open position in which air may flow through the valve means 70 into the pad receiving cavity 18 and out of the pad receiving cavity 18 and a closed position in which air is prevented from entering or leaving the pad receiving cavity 18. Thus, when it is desired to "roll up" the seating arrangement of the embodiment 10, the valve 70 may be opened, the air evacuated therefrom as the pad is rolled, and, thus, provides a smaller volume for storage and carrying. When it is desired to utilized the seating arrangement of the embodiment 10, the valve may be opened and atmospheric air allowed to enter into the body of the pad receiving cavity 18. Additionally, if desired, air may be blown into the pad receiving cavity 18 through the valve 70 to thus inflate the pad receiving cavity 18 to a pressure in excess of atmospheric pressure for greater firmness of the seating arrangement 10 as may be desired for particular applications.

Figure 5:
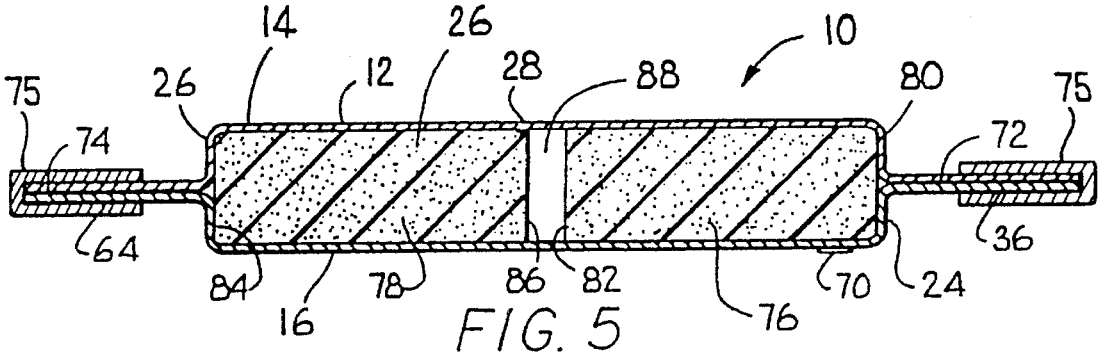
FIG. 5 is a sectional view along the line 55 of FIG. 2.

Referring now to FIG. 5, there is illustrated a sectional view taken along the line 55 of FIG. 2. As shown in FIG. 5, the lower surface 16 and upper surface 14 of the body means 12 are, in preferred embodiments of the present invention, bonded to the pad means generally designated 26 throughout the extent of the upper layer 14 and lower layer 16. Similarly, the first flexible flap means 36 is comprised of extensions of the upper layer 14 and lower layer 16 bonded to each other as indicated at 72. Similarly, though not shown in FIG. 6, the first and second tab portions 46 and 48 may be comprised of extensions of the upper layer 14 and lower layer 16 extending from the portions thereof forming the first flap means 36. However, for economy of manufacture, it may be desired in certain applications to have the first, second, third, and fourth tab means, as above described, fabricated from separate materials and then sewn, bonded, or otherwise secured to the first and second flap means to provide the attachment for the flexible strap means as above described. Similarly, the second flexible flap means 64 may also be comprised of extensions of the upper layer 14 and lower layer 16 bonded together as indicated at 74.

In the embodiment as illustrated in FIG. 5, the pad means 26 is comprised of a back portion 76 and a seat portion 78. The back portion 78 has a remote end 80 adjacent the first end peripheral edge 24 and an inner edge 82 spaced from the edge 80. Similarly, the seat portion 78 has a remote edge 84 adjacent the second end peripheral edge 26 and an inner edge 86 spaced therefrom. The inner edges 82 and 86 in the embodiment 10 are spaced from each other to leave a portion generally designated 88 extending between the peripheral edges 20 and 22 free of the pad means 26. The space 88 provides the fold line 28 for the embodiment 10 to allow the folding into the position shown in FIG. 1. In the fabrication of the seating arrangement of the embodiment of FIG. 10, the upper layer 14 is not bonded to the lower layer 16 in the space 88. Further, the pad means 26 comprised of the back portion 76 and seat portion 78 in the embodiment 10 is comprised of an open-cell foam. In preferred embodiments of the present invention, the open-cell foam of the pad means 26 has a density on the order of 1.4 to 1.7 pounds per cubic foot. However, it will be appreciated, densities higher or lower than such values may be utilized as desired for particular applications. The pad means 26 is preferably a flexible open-cell polyurethane foam. The body means 12 may be comprised of a nylon outer layer and a suitable thermoplastic or thermosetting inner layer or a plurality of such layers for bonding the pad means 26 to the body means 12 and for allowing the bonding of the upper layer 12 to the lower layer 16 in the region, for example, at 74 and 76.

The inner edges 82 and 86 of the pad portion 76 and 78, respectively, defining the space 88 are spaced apart by a dimension on the order of ¼ inch to 1½ inches in preferred embodiments of the present invention.

Figure 6:
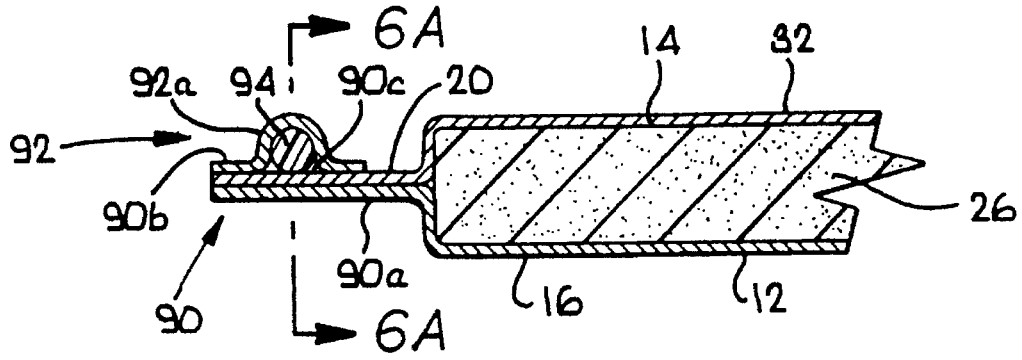
FIG. 6 is a sectional view along the line 66 of FIG. 2.

In order to provide greater stability to the seating arrangement 10 when in the seating position as indicated in FIG. 1, it is preferred that there be rigid stiffening means preferably removeably insertable along the peripheral edges 20 and 22 in both the back portion 30 and seat portion 32. FIG. 6 is a sectional view along the line 66 of FIG. 2 and illustrates a preferred arrangement of one aspect of the present invention for the provisions of the stiffening means. As illustrated in FIG. 6, the upper layer 14 and lower layer 16 are bonded together along the peripheral edge 20 as indicated at 90. A pocket means generally designated 92 is provided and may be a cloth, plastic, or any other desired material into which a rigid member generally designated 94 may be removably inserted. The rigid member 94 may be a nylon rod or the like. The rigid member 94 is preferably removable from the pocket means 92 to provide for more convenient rolling and storage of the seating arrangement 10 in both directions of its extent.

The pocket means 92 may, for example, be a plastic webbing so as to provide the desired strength for retaining the rods 94 and resisting tearing or abrasion during repeated insertion and removal of the rods 94.

Figure 6A:
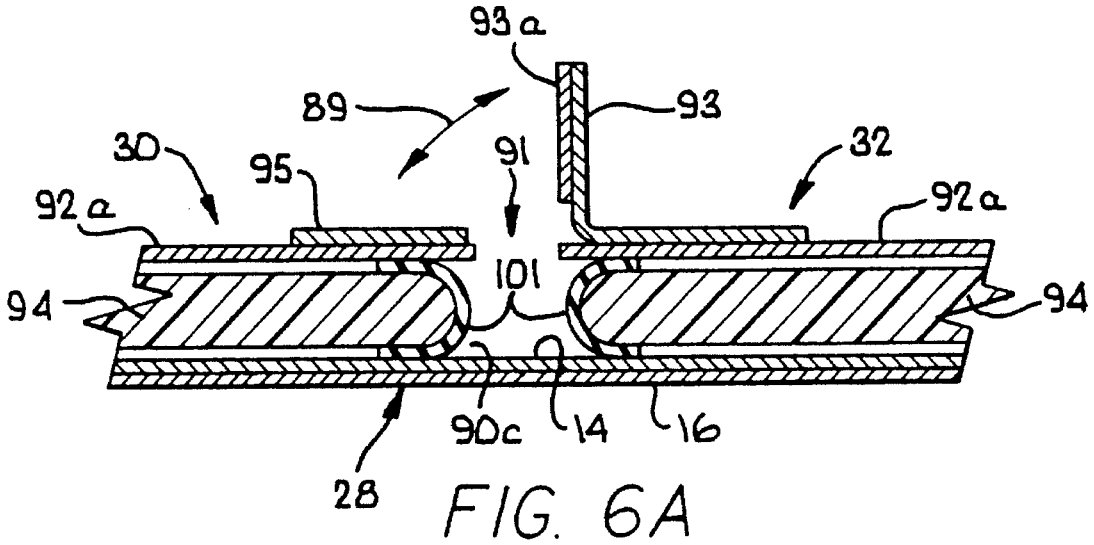
FIGS. 6A and 6B illustrate the preferred rod retention arrangement of the present invention.
Figure 6B:
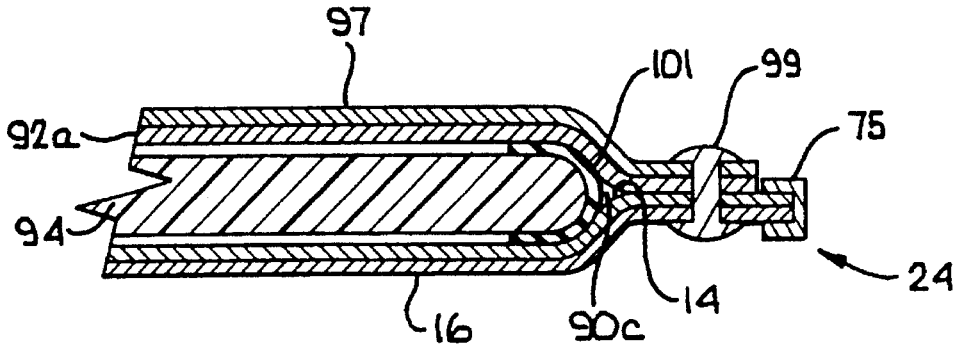

FIGS. 6, 6A, and 6B illustrate the details of the preferred pocket means 92 of the present invention. The various details of the pocket means 92 of the present invention have been omitted from FIGS. 1 through 4 hereof for clarity.

As shown on FIGS. 6, 6A, and 6B, the pocket means 92 is comprised of the member **92*a* which may be coupled, for example by sewing, to the peripheral edge 20 in the area 90 at, for example, the portions 90*a* and 90*b* to define the rod receiving cavity 90*c*. The member 92*a* may be a plastic webbing having sufficient strength to resist tearing and abrasion during repeated insertion and removal of the rod 94**.

FIG. 6A shows the preferred arrangement for the pocket means 92 at the fold line 28. A first strap means 93 is coupled to the member **92*a* in regions adjacent the fold line 28 at the seat portion 32 by, for example, sewing thereto. A "hook" portion 93*a* of a detachable hook and loop coupling means is coupled, for example, by sewing to the first strap means 93**.

The member **92*a* is provided with a slit 91 therein at the fold line 28**.

The first strap means 93 is moveable in the direction of the arrow 89 to allow the hook portion **93*a* to engage the lop portion 95 coupled to the member 92*a* at the seat portion 30. For the position shown in FIG. 6A, the rods 94 may be inserted through the slit 91 into the rod receiving cavity 90*c* and then the hook portion 93*a* may be engaged with the loop portion 95 to close the slit 91**.

The remote ends of the pocket means 92 at the first end peripheral edge 24 and second end peripheral edge 24' may also be reinforced. FIG. 6B illustrates the reinforcing at the end 24. Edge binding 75 is provided at the end 24 to bind, for example, by sewing the ends of the upper and lower layers 14 and 16. A second strap means 97 is coupled to the member **92*a* in regions adjacent end 24 and may be secured thereto by sewing and, if desired, by rivet means 99**.

For additional wear resistance, the ends of the rods 94 may be provided with a tip means 101 which, for example, may be plastic, rubber, or the like.

The overall thickness of the pad means 26 may be in the range of ½ to 2 inches though, of course, greater or smaller values may be utilized as desired for particular applications. The transverse width of the member **92*a* may be on the order of 1⅛" to 1¼". The rods 94** may be on the order of ¼" diameter and made of nylon, or the like.

Figure 7:
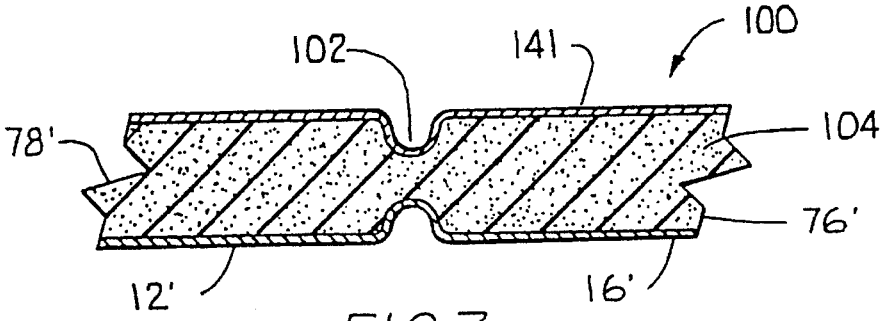
FIG. 7 is a partial sectional view of another embodiment of the present invention.

FIG. 7 illustrates another embodiment of the present invention generally designated 100 and, in particular, is a sectional view showing another structural arrangement for providing a fold line generally illustrated at 102. In the embodiment 100, there is an upper layer generally designated 14' and a lower layer generally designated 16' of a body member generally designated 12' which is similar to the body member 12 described above. The pad means 104 is an open-cell foam which may have the same physical characteristics as the pad means 26 described above except that it is continuous between the back portion 76' and seat portion 78'. The fold line 102 is provided by partially collapsing the pad means 104 along a line extending between the lateral edges 20 and 22 (not shown in FIG. 7) generally in the same position as that shown for the space 88 of FIG. 5. Care must be taken in such an embodiment that when the fold line 102 is formed that the pad means 104 extending there along not be collapsed completely since such would prevent the flow of air between the seat portion 78 and back portion 76 as desired for inflation and deflation thereof.

Figure 8:
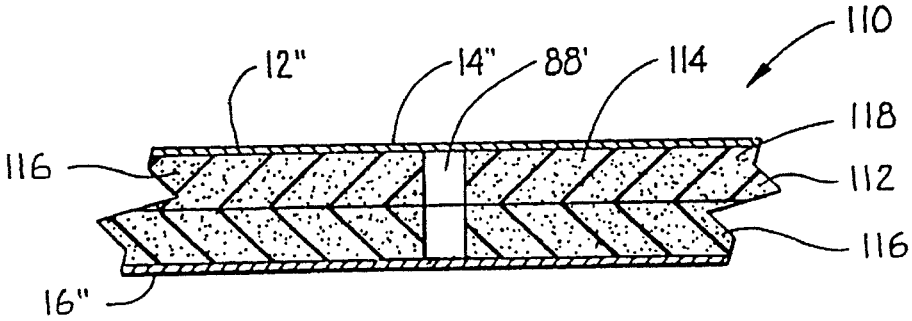
FIG. 8 is a partial sectional view of another embodiment of the present invention.

FIG. 8 illustrates another embodiment of the present invention generally designated 110 in which there is provided a body member 12" having an upper layer 14" and a lower layer 16". The pad means generally designated 112 is comprised of two layers: a first open-cell foam layer generally designated 114 which may have the same density pad means 26 described above and be comprised of an open-cell foam. However, it is preferably only half of the thickness of the pad means 26 described above.

A second pad means layer 116 is provided substantially coextensive with the first layer 114 and the pad layer 116 may be a close-cell foam and, if desired, extend in the space 88' between the seat portion of the pad means 114 generally designated 116 and the back portion thereof generally 118. Thus, the layer 116 may be separated into the two separate portion similar to the two portions of the pad means 118 or it may be continuous through the space 88'.

FIG. 9 illustrates another embodiment of the present invention generally designated 130 which is similar to the embodiment shown in FIG. 7 except that it incorporates two continuous pad layers. The first pad layer 114' may be an open-cell foam layer similar to the layer 114 but continuous, that is, without any space 88', and the second layer 116' may be a closed-cell foam and also continuous. The fold like 102' is provided by partially collapsing at least the first pad layer 114' but still allowing a portion thereof to communicate through the fold line so that communication and air flow between the sections may be provided as described above. The closed-cell layer 116' may be totally collapsed down to the interface 132 or partially collapsed as illustrated in FIG. 9 since air flow between the sections does not occur with the close-cell foam.

FIGS. 10 and 11 illustrate another embodiment of the present invention generally designated 140. The construction of the embodiment 140 may be generally similar to any of the constructions of the embodiments described above except that the seat portion generally designated 142 is elongated to be a length greater than the back portion 144. In the flat position thereof, as illustrated in FIG. 11, therefore, the seating arrangement 140 may be utilized as a sleeping pad or mat as well as a seating arrangement, as illustrated in FIG. 10.

In the embodiment 140, it may not be necessary to extend the second flexible flap means between the lateral edges thereof. Thus, the third and fourth tab means 146 and 148 may be comprised of extensions of the upper layer generally designated 150 and lower layer generally designated 160 bonded together as described above or, alternatively, they may be separate portions sewn or otherwise secured to the peripheral edges. It will be appreciated, of course, that even in the embodiment 10 shown on FIG. 1 it may sometimes be desirable to eliminate the second flexible flap means and just provide the tab portions coupled to the peripheral edges.

As shown in FIGS. 10 and 11, the embodiment 140 is provided with a plurality, namely two, fold lines 28*a*' and 28*a*" in parallel spaced apart relationship. The fold lines 28*a*' and 28*a*" divide the embodiment 140 into three sections. The three sections are the back portion 144, the seat portion 142 and an intermediate portion 143. The lateral length of the portion 144 is indicated at $l_3$; the lateral length at the seat portion 142 is indicated at $l_1$; and the lateral length of the intermediate portion is indicated at $l_2$. The lengths of $l_1$, $l_2$, and $l_3$ may be the same or may be different as desired for different applications.

The seat portion 142 may be moved in the directions indicated by double ended arrow 105 and, if desired, rotated to overlay the intermediate portion 143 to provide a "double" thickness for more comfortable seating.

The embodiment 140, as well as all other embodiments, may be provided with the pocket means 92 as described in connection with FIGS. 6, 6A, and 6B.

Additionally, detachable coupling means 170 comprising a plurality of flexible hook and loop flexible straps designated 172 may be coupled to the lateral edges of the embodiment 140 in regions adjacent the remote ends 144*a* and 142*a*. The straps 172 may be detachable inserted and secured in rings 174 coupled to the lateral edges of the embodiment 140 at preselected locations to be engageable by the straps 172.

For convenient management of the embodiment 140, the seat portion 142 may be folded along fold line 28*a*" to overlie the intermediate portion 143 and the appropriate straps 170 engaged with the rings 174 for detachable retention in such configuration. Similarly, the back portion 144 may be rotated over the seat portion 142 and intermediate portion 143 and the appropriate straps 172 engaged with the rings 174 for retention. In this confirmation the embodiment is in a folded, compact configuration making moving and handling thereof more convenient.

For additional comfort, an inflatable pillow may be provided for detachable mounting on any of the embodiments of the present invention, or other similar devices.

Figure 12:
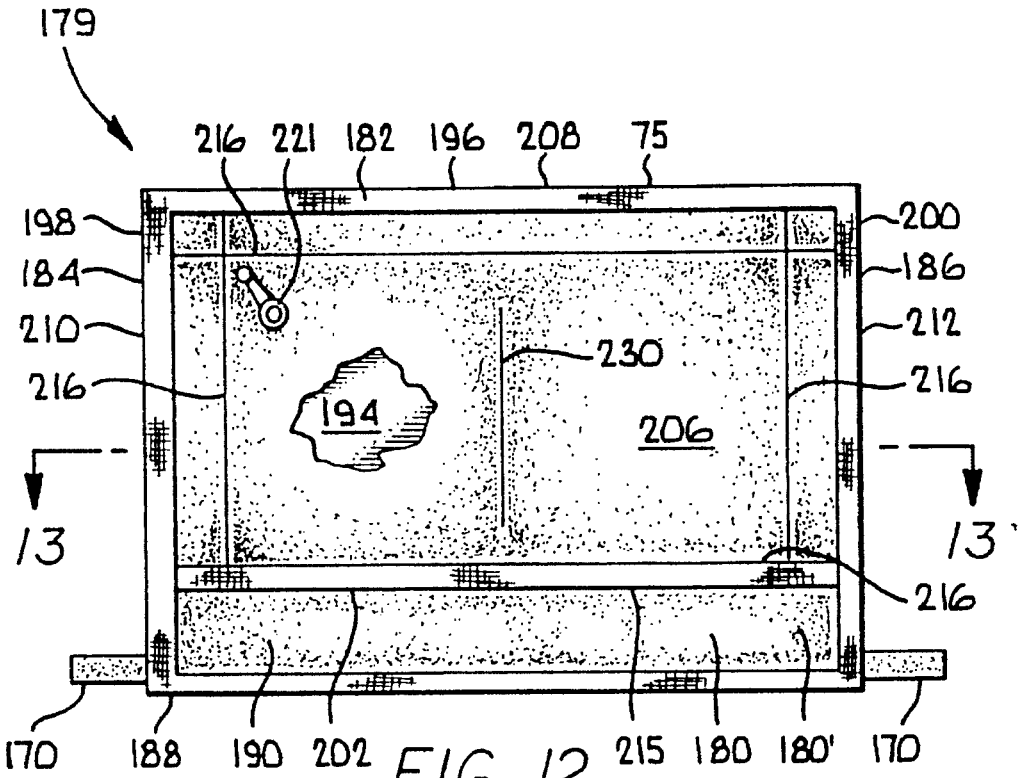
FIGS. 12 and 13 illustrate an inflatable pillow of the present invention.
Figure 13:
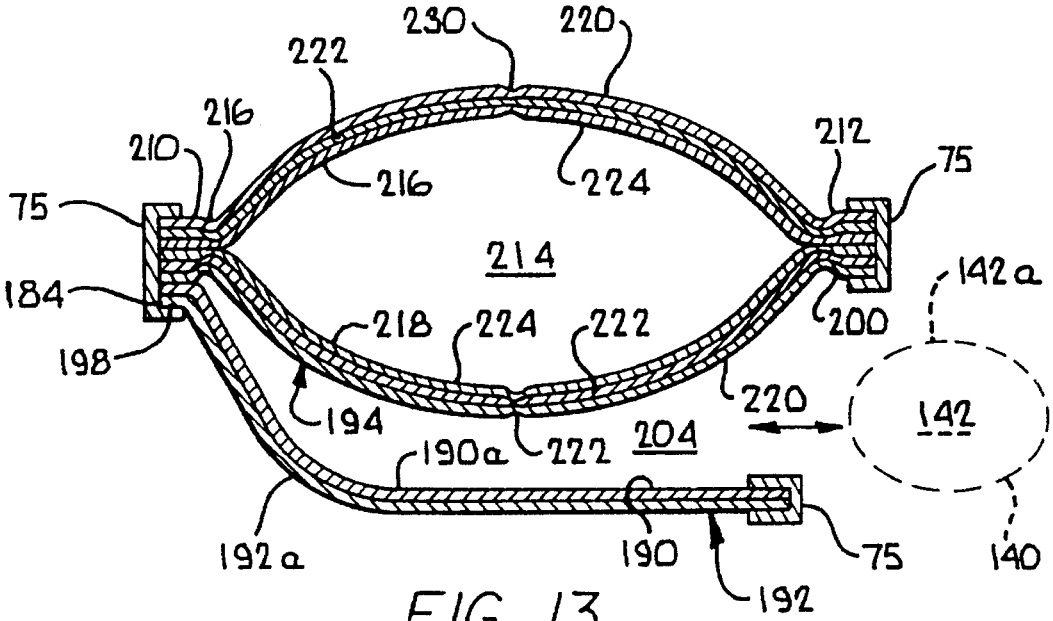

FIGS. 12 and 13 illustrate a preferred arrangement of an inflatable pillow generally designated 179 according to the principles of the present invention.

As illustrated in FIGS. 12 and 13, there is provided an inflatable pillow which may be detachably mounted on any of the embodiments of the present invention. The inflatable pillow generally has a first flexible wall member 180 which has a first edge 182, a second edge 184, a third edge 186, and a fourth edge 188. The first flexible wall member 180 also has a inside surface 190 and an outside surface 192. The first flexible wall member may be comprised of, for example, a decorative outer covering 192*a* and preferably a waterproof such as a waterproof nylon inside material 190*a*. The pillow 179 is also provided with a second flexible wall member generally designated 194 which has a first edge 196, a second edge 198, a third edge 200, and a fourth edge 202. The first edge 182 of the first flexible wall member 180 is substantially coextensive with and coupled to the first edge 196 of the second flexible wall member. The second edge 184 of the first flexible wall member 190 is coupled in preselected portions thereof to the second edge 198 of the second flexible wall member. Similarly, the third edge 186 of the first flexible wall member 190 is coupled in preselected portions to the second edge 200 of the second flexible wall member 194. The first flexible wall member 180 has a length between the first edge 182 and fourth edge 188 that is greater than the length between the first edge 196 and fourth edge 202 of the second flexible wall member 194 to define the portion 180' as shown on FIG. 12. The coupling of the first flexible wall member 182, the second flexible wall member 194, as above described, defines a pocket 204 therebetween which is closed on three sides and open at the fourth end 188 of the first flexible wall member 180. A sleeping mat and/or chair arrangement such as the embodiment 140 described above in connection with FIGS. 11 and 12, and as illustrated in dotted lines on FIG. 13, may be inserted into the pocket 204 for detachable retention of the pillow 179 on the embodiment 140. Similarly, any of the other embodiments described above may be inserted into the pocket 204.

A third flexible wall member generally designated 206 is substantially identical to the second flexible wall member 194 and has a first edge 208, a second edge 210, a third edge 212, and a fourth edge 215, which are coupled, respectively, to the first edge 196, second edge 198, third edge 200, and fourth edge 202 of the second flexible wall member 194 to define a cavity 214 between the opposed intermediate surface 216 of the third flexible wall member 206 and the intermediate surface 218 of the second flexible wall member 194. The first and second flexible wall members are a multilayer arrangement in which they each have an outer decorative covering generally designated 220, an inner, for example, nylon layer 222, and an interior layer 224 which may be of a thermoplastic material. The inner layers 224 of the second flexible wall member 194 and 206 may be bonded together in an air-tight sealing relationship as indicated at 216 by heat sealing to provide the cavity 214 as an air-tight cavity which may be inflated through valve means 221. Valve means 221 may be of conventional design and may, for example, be similar to the valve means 70 described above.

Edge binding 75 similar to that described above in connection with FIG. 6 may be utilized around the first, second, third, and fourth edges of the first, second, and third flexible wall members to bind such edges together, for example, by sewing.

Stiffening means generally indicated at 230 and 232, which may be compressed, heated portions of the second flexible wall member and third flexible wall member, respectively, may be utilized to reduce the "bowing" or separation therebetween in the inflated condition.

This concludes the description of the preferred embodiments of the present invention. It will be appreciated that the embodiments described above are not intended to be limiting to the invention and all embodiments falling within the true scope and spirit of the appended claims are intended to be covered thereby.

What is claimed:

1. An inflatable pillow arrangement comprising, in combination:

a first flexible wall member having a first edge, a second edge, an third edge, and a fourth edge, and having an inside surface and an outside surface extending between said first edge, said second edge, said third edge, and said fourth edge;

a second flexible wall member having a first edge, a second edge, a third edge, and a fourth edge, an inner surface and an intermediate surface, extending between said first edge, said second edge, said third edge, and said fourth edge thereof, and said first edge of said first flexible member substantially coextensive with and coupled to said first edge of said second flexible wall member, said second edge and said third edge of said second flexible wall member coupled to said second edge and said third edge, respectively, of said first flexible wall member along a preselected extent thereof, and said fourth edge of said second flexible wall member spaced from said fourth edge of said first wall member, and said first flexible wall member and said second flexible wall member defining a pocket therebetween;

a third flexible wall member having a first edge, a second edge, a third edge, and a fourth edge substantially coextensive with and coupled to said first edge, said second edge, said third edge, and said fourth edge of said second flexible wall member and having an intermediate surface in opposed relationship to said intermediate surface of said second flexible wall member and an outer surface to define a cavity therebetween;

said second flexible wall member and said third flexible wall member substantially air tight in regions defining said cavity;

sealing means for coupling said intermediate surface of said second flexible wall member to said intermediate surface of said third flexible wall member in an air-tight sealing relationship in regions spaced from said first edge, said second edge, said third edge, and said fourth edge of each of said second flexible wall member and said third flexible wall member to define an inflatable pillow portion of said cavity, and margin portions extending from said sealing means to said first edge, said second edge, said third edge, and said fourth edge of said second and said third flexible wall member; and valve means in said third flexible wall member providing communication between said pillow portion of said cavity and regions external said outer surface of said third flexible wall member for selectively allowing inflating and deflating of said inflatable pillow portion of said cavity.

2. The arrangement defined in claim 1 wherein said intermediate surface of said second flexible wall member and said third flexible wall member have a thermoplastic coating thereon.

3. The arrangement defined in claim 2 wherein said sealing means further comprises a heat sealed margin between said thermoplastic coating on said intermediate surface of said second flexible wall member and third flexible wall member.

4. The arrangement defined in claim 2 wherein said second flexible wall member and said third flexible wall member each comprise a multilayer wall member having an interior layer of a thermoplastic material, an intermediate layer of nylon, and an outer layer of a decorative fabric.

5. The arrangement defined in claim 1 and further comprising:

coupling means mounted on said first flexible fabric member in regions adjacent said fourth edge for detachable coupling.

6. The arrangement defined in claim 5 wherein said first, said second, said third, and said fourth edge portions of each of said first flexible wall member, said second flexible wall member, and said third flexible wall member are coupled together by an edge binding sewn therethrough.

7. The arrangement defined in claim 1 and further comprising:

a stiffening means in regions adjacent the center of said pillow portion of said cavity in said second flexible wall member and said third flexible wall member for reducing the inflated separation therebetween.

8. An inflatable pillow of the type adapted to be removable mounted on an end portion of a sleeping mat or chair arrangement and comprising, in combination:

a first planar flexible wall member;

a second planar flexible wall member;

a third planar flexible wall member;

said first, said second, and said third planar flexible wall members coupled together along preselected peripheral edge portions thereof to define a camping mat or a chair arrangement end portion receiving cavity between said first and said second planar flexible wall members;

said second flexible wall member and said third flexible wall member coupled together in air-tight sealing relationship in regions adjacent the peripheral edges thereof to define an air-tight inflatable pillow cavity therebetween;

valve means coupled to said third flexible wall member for providing selective air flow into and out of said inflatable pillow cavity; and coupling means on said first planar flexible wall member at preselected locations thereof for detachable coupling to the camping sleeping mat or chair arrangement.

9. The arrangement defined in claim 8 wherein said coupling means comprises a flexible strap means having engageable hook and loop portions for encircling a ring means on the camping mat or chair arrangement.

* * * * *